US011000112B1

(12) United States Patent
Thomas

(10) Patent No.: US 11,000,112 B1
(45) Date of Patent: May 11, 2021

(54) BACKPACK AND HOOD COMBINATION DEVICE

(71) Applicant: Winston Thomas, Indianapolis, IN (US)

(72) Inventor: Winston Thomas, Indianapolis, IN (US)

( * ) Notice: Subject to any disclaimer, the term of this patent is extended or adjusted under 35 U.S.C. 154(b) by 63 days.

(21) Appl. No.: 16/682,441

(22) Filed: Nov. 13, 2019

(51) Int. Cl.

| | |
|---|---|
| ***A45F 4/12*** | (2006.01) |
| ***A45F 3/04*** | (2006.01) |
| ***A42B 1/04*** | (2021.01) |
| ***A45C 13/02*** | (2006.01) |
| ***A45C 13/10*** | (2006.01) |
| ***A45F 3/12*** | (2006.01) |
| *A45F 3/00* | (2006.01) |

(52) U.S. Cl.
CPC ..... *A45F 4/12* (2013.01); *A45C 13/02* (2013.01); *A45C 13/103* (2013.01); *A45F 3/047* (2013.01); *A45F 3/12* (2013.01); *A42B 1/04* (2013.01); *A45F 2003/003* (2013.01)

(58) Field of Classification Search
CPC ..... A45F 4/12; A45F 3/047; A45F 2003/003; A42B 1/04
USPC ..... 224/153, 154, 156
See application file for complete search history.

(56) References Cited

U.S. PATENT DOCUMENTS 4,096,978 A * 6/1978 Noice ..... A45F 3/04 224/640
4,515,300 A * 5/1985 Cohen ..... A45F 3/04 224/153
4,792,040 A * 12/1988 Wagstaff, III ..... A41D 3/06 150/167
D323,237 S 1/1992 Zoltie
5,154,332 A * 10/1992 Williams ..... A45C 13/002 190/26
5,165,111 A 11/1992 Lieberman
D339,912 S 10/1993 Delauter
5,439,153 A * 8/1995 Murdoch ..... A45C 13/002 150/159
5,676,293 A 10/1997 Farris
5,797,529 A * 8/1998 Lavine ..... A45C 7/0077 190/103
5,815,833 A * 10/1998 Kuo ..... A41D 15/04 2/69.5
5,934,527 A * 8/1999 Von Neumann ..... A45C 7/0086 224/153
6,279,796 B1 * 8/2001 Trevino ..... A45C 13/002 150/154
6,295,689 B1 * 10/2001 Sciacca ..... B25G 1/06 15/143.1

(Continued)

*Primary Examiner* — Justin M Larson

(57) ABSTRACT

A backpack and hood combination device for shielding a user's head includes a backpack and a hood. The backpack comprises a pair of shoulder straps that is configured to position over shoulders of a user to couple the backpack to the user. An upper limit of the backpack is positioned proximate to a base of a neck of the user and a rear of the backpack substantially abuts a back of the user. The hood is coupled to and positioned in a pouch that is coupled to the upper limit proximate to the rear of the backpack. The hood is selectively extensible from the pouch through a pouch opening that is positioned in the pouch. The hood is configured to cover a head of the user to protect the head of the user from windchill and moisture.

19 Claims, 7 Drawing Sheets

(56) References Cited

U.S. PATENT DOCUMENTS 6,315,178 B1 * 11/2001 Nobata ..... A45F 3/04 224/153
6,460,746 B1 * 10/2002 Amram ..... A45F 3/047 224/579
6,505,762 B2 * 1/2003 Wilfer ..... A45F 3/04 206/314
6,543,658 B2 * 4/2003 Trevino ..... A45C 13/002 224/153
6,564,388 B1 * 5/2003 Poston ..... A41D 15/04 2/84
6,843,398 B2 1/2005 Zion
D509,653 S * 9/2005 Yu ..... D3/216
7,374,071 B2 * 5/2008 Lavelle ..... A41D 3/08 2/94
D619,802 S * 7/2010 Hedaya ..... D3/216
D635,761 S * 4/2011 Hedaya ..... D3/216
8,152,374 B2 * 4/2012 Shaul ..... A45C 13/002 383/37
D669,257 S 10/2012 Hedaya
8,556,140 B2 * 10/2013 Almoumen ..... A45F 3/04 224/155
9,125,477 B2 9/2015 Killion
9,427,058 B2 * 8/2016 Boglione ..... A45C 5/03
D781,532 S 3/2017 Kelly
9,596,921 B1 3/2017 Blanton
9,681,739 B2 * 6/2017 Killion ..... A41D 15/04
9,867,453 B1 * 1/2018 Diaz ..... A41D 15/04
10,136,721 B2 * 11/2018 Blanton ..... A45F 3/04
10,188,196 B2 * 1/2019 Thibadeau ..... A45F 3/04
D888,431 S * 6/2020 Grismer ..... D3/318
10,758,029 B1 * 9/2020 Grismer ..... A45F 4/12
D911,675 S * 3/2021 Grismer ..... D2/853
2001/0017307 A1 * 8/2001 Bentzen ..... A45F 3/08 224/634
2003/0116392 A1 * 6/2003 Oh ..... A45C 13/002 190/102
2003/0205593 A1 * 11/2003 Lavelle ..... A41D 3/08 224/153
2005/0050614 A1 * 3/2005 Leung ..... A41D 3/08 2/209.13
2005/0242143 A1 * 11/2005 Hassett ..... G11B 33/025 224/576
2006/0086444 A1 * 4/2006 Yu ..... A45C 13/002 150/154
2007/0017764 A1 * 1/2007 Cheng ..... A45C 13/002 190/100
2008/0023513 A1 * 1/2008 Hadj-Chikh ..... A45F 3/04 224/645
2009/0184143 A1 * 7/2009 Witt ..... A45C 7/0086 224/153
2009/0272773 A1 * 11/2009 Andrade ..... A47D 13/025 224/153
2010/0071395 A1 * 3/2010 Ledoux ..... F25D 3/08 62/259.1
2010/0078457 A1 4/2010 Pitchford
2010/0127024 A1 * 5/2010 Cortes ..... A45F 4/02 224/153
2012/0121210 A1 * 5/2012 Meyer ..... A45C 13/008 383/4
2013/0026204 A1 * 1/2013 Abramowitz ..... A43B 5/0425 224/613
2014/0131412 A1 * 5/2014 Canton ..... A45F 3/04 224/640
2015/0203281 A1 * 7/2015 Russo ..... A42B 1/048 206/458
2016/0095400 A1 * 4/2016 Lawton ..... A45C 13/02 206/292
2019/0110565 A1 * 4/2019 Cunha ..... A45C 13/002
2020/0205554 A1 * 7/2020 Deioma ..... A45F 3/04
2020/0383458 A1 * 12/2020 Kersting ..... A45F 4/04

* cited by examiner

BACKPACK AND HOOD COMBINATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to backpack devices and more particularly pertains to a new backpack device comprising a hood for shielding a user's head.

(2) Description of Related Art Including Information Disclosed Under 37 CFR 1.97 and 1.98

The prior art relates to backpack devices. Prior art backpack devices providing a hood may comprise a hood coupled to the backpack by a strap, a hood coupled directly to the backpack, or a hood selectively deployable from the backpack.

BRIEF SUMMARY OF THE INVENTION

An embodiment of the disclosure meets the needs presented above by generally comprising a backpack and a hood. The backpack comprises a pair of shoulder straps that is configured to position over shoulders of a user to couple the backpack to the user. An upper limit of the backpack is positioned proximate to a base of a neck of the user and a rear of the backpack substantially abuts a back of the user. The hood is coupled to and positioned in a pouch that is coupled to the upper limit proximate to the rear of the backpack. The hood is selectively extensible from the pouch through a pouch opening that is positioned in the pouch. The hood is configured to cover a head of the user to protect the head of the user from windchill and moisture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
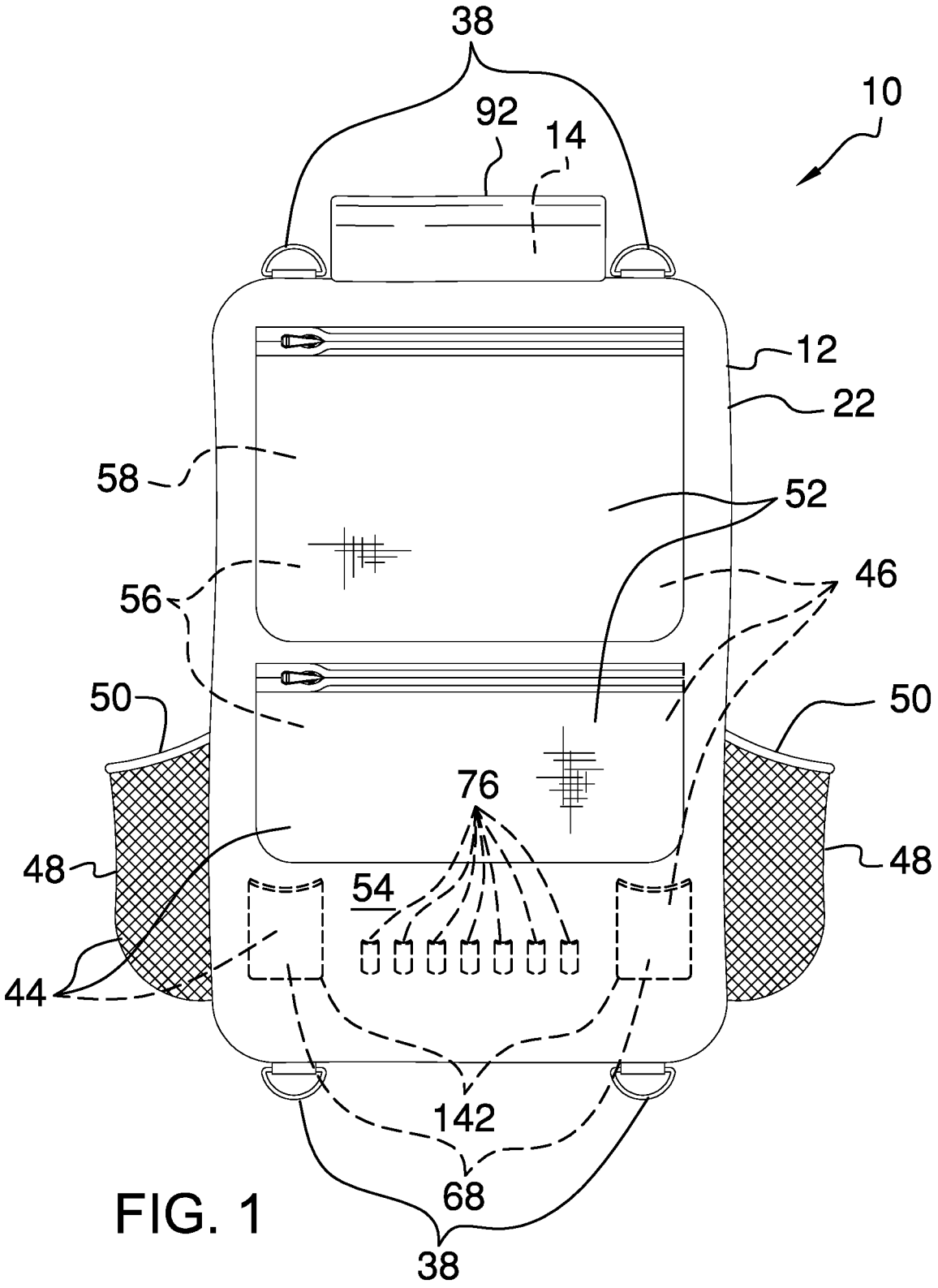
FIG. 1 is a front view of a backpack and hood combination device according to an embodiment of the disclosure.
Figure 2:
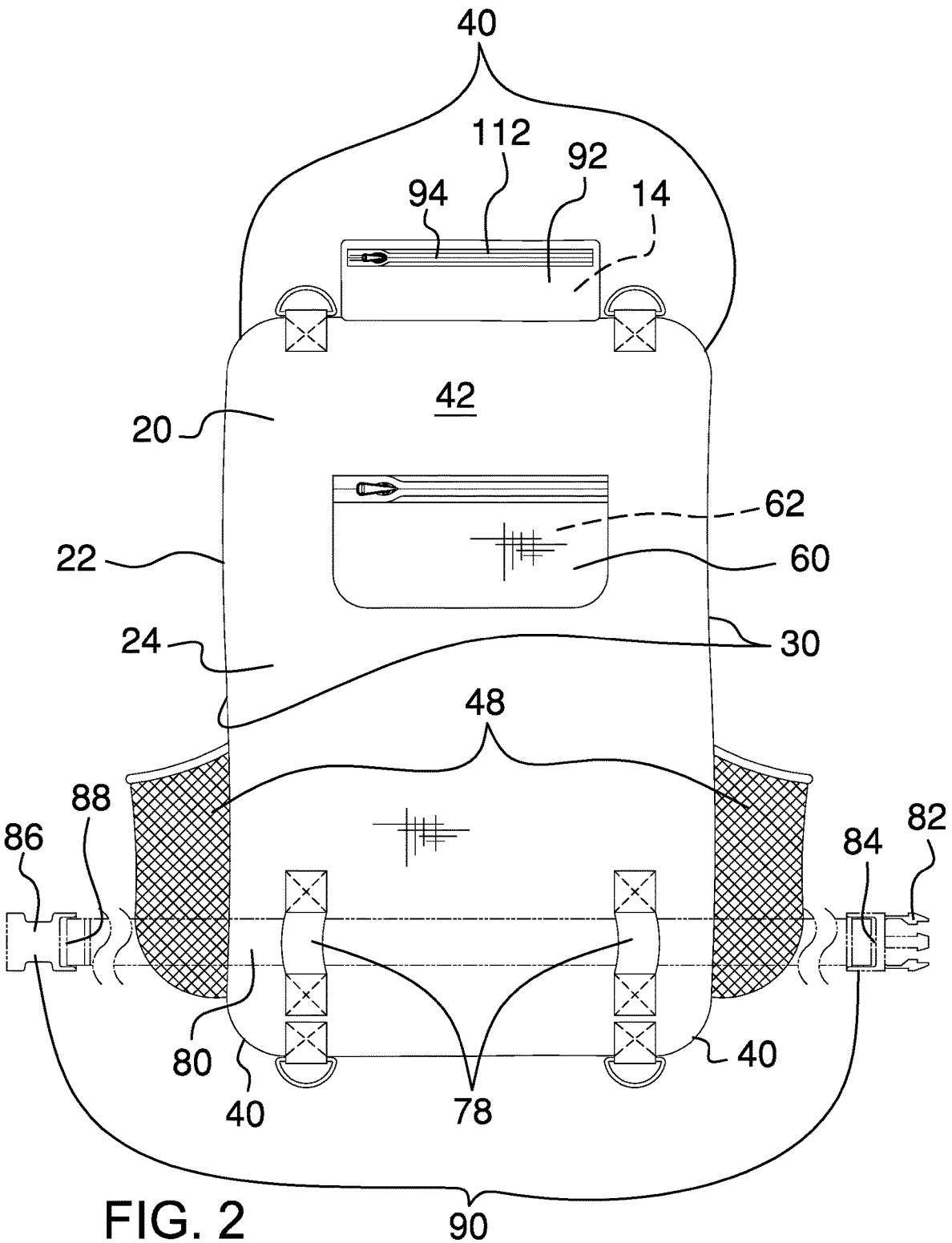
FIG. 2 is a rear view of an embodiment of the disclosure.

With reference now to the drawings, and in particular to FIGS. 1 through 7 thereof, a new backpack device embodying the principles and concepts of an embodiment of the disclosure and generally designated by the reference numeral 10 will be described.

Figure 3:
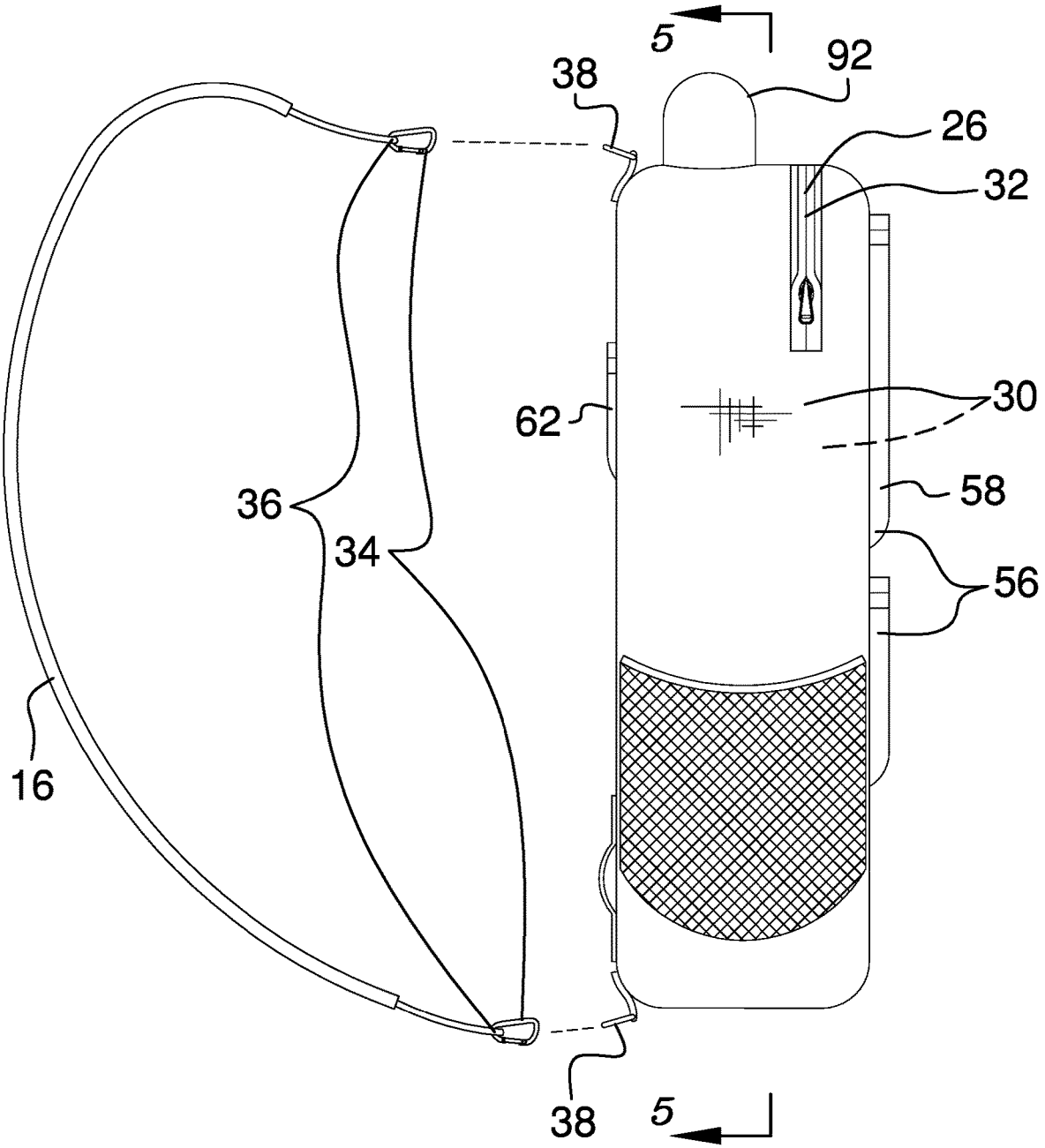
FIG. 3 is a side view of an embodiment of the disclosure.
Figure 4:
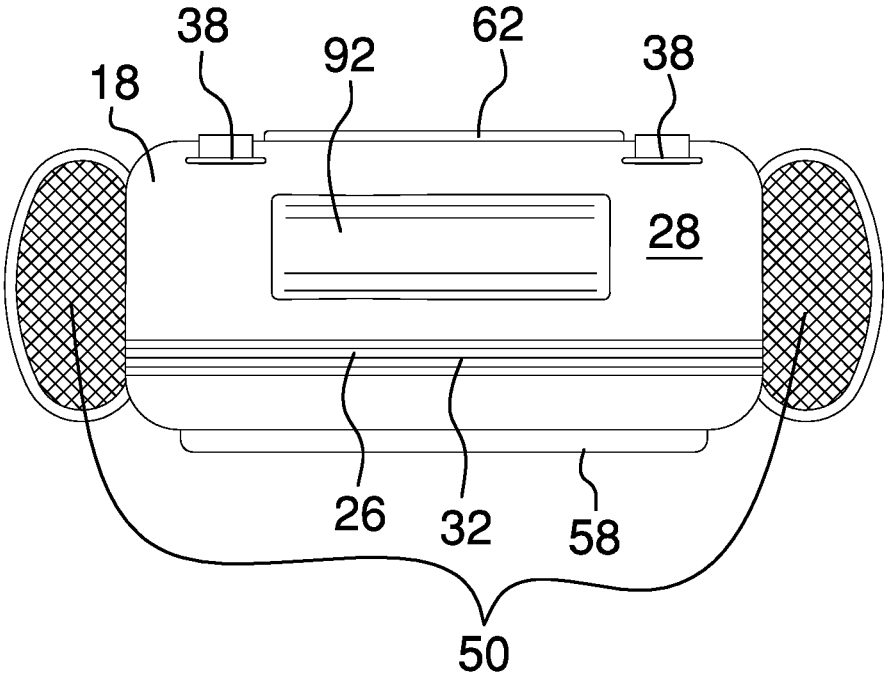
FIG. 4 is a top view of an embodiment of the disclosure.
Figure 5:
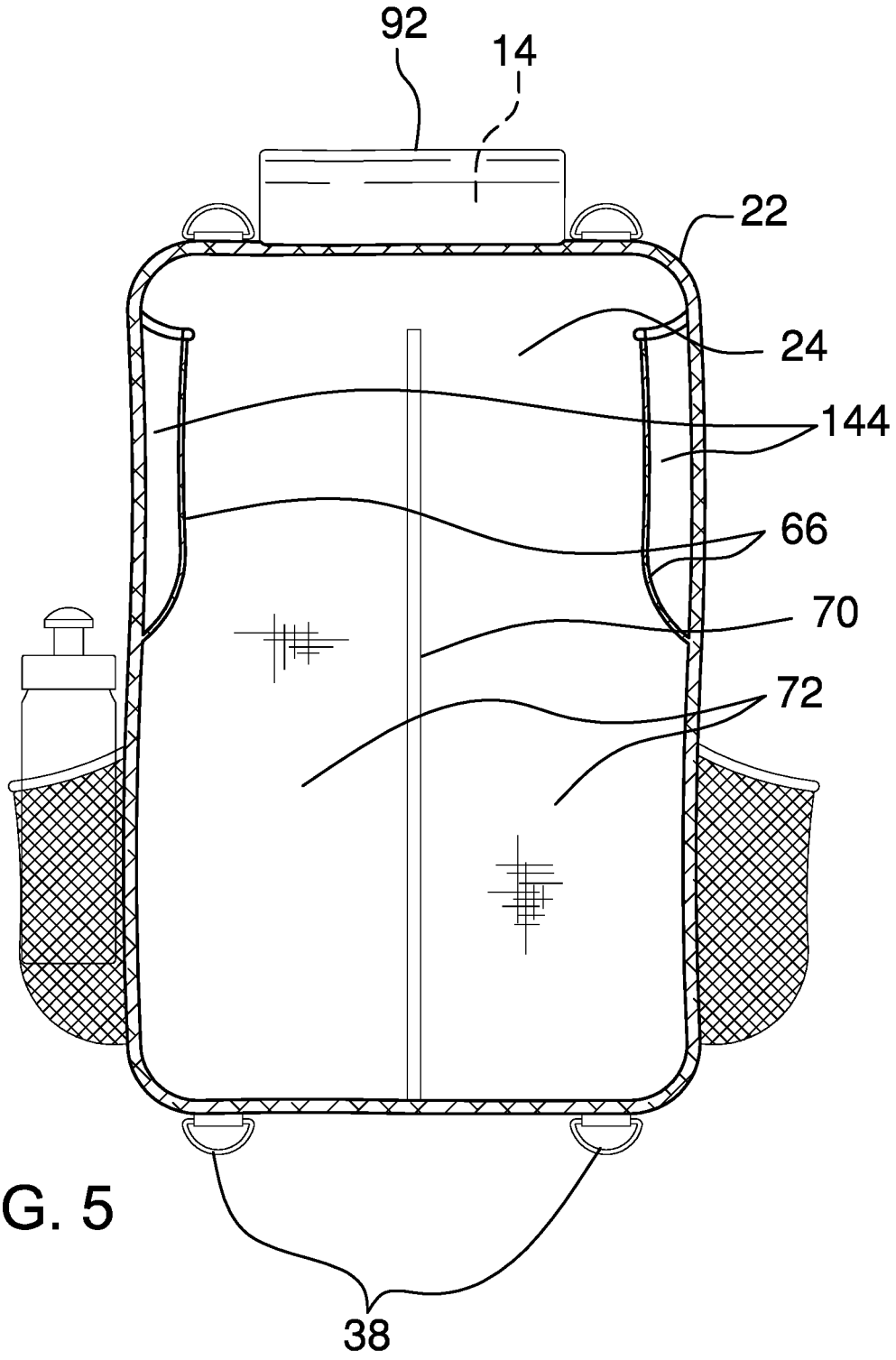
FIG. 5 is a cross-sectional view of an embodiment of the disclosure.

As best illustrated in FIGS. 1 through 7, the backpack and hood combination device 10 generally comprises a backpack 12 and a hood 14. The backpack 12 comprises a pair of shoulder straps 16 that is configured to position over shoulders of a user to couple the backpack 12 to the user. An upper limit 18 of the backpack 12 is positioned proximate to a base of a neck of the user and a rear 20 of the backpack 12 substantially abuts a back of the user. The shoulder straps 16 may be padded, as shown in FIG. 3.

The backpack 12 comprises a shell 22 that defines an interior space 24. The shell 22 comprises synthetic fiber so that the shell 22 is resiliently flexible and substantially water resistant. The shell 22 may be substantially rectangularly box shaped or may be alternatively shaped, such as ovally shaped, disc shaped, and the like.

A slit 26 is positioned in an upper face 28 of the shell 22 and extends into opposing sides 30 of the shell 22. The slit 26 is configured to allow access to the interior space 24. A slit closure 32 that is coupled to the shell 22 proximate to the slit 26 is positioned to selectively close the slit 26. The slit closure 32 may be waterproof zipper type, or other closure type, such as, but not limited to, hook and loop type, snap type, and the like.

The backpack 12 comprises a set of hooks 34, with the hooks 34 being coupled singly to opposing limits 36 of the shoulder straps 16. The hooks 34 may carabiner type, or other shackle type. The present invention also anticipates the shoulder straps 16 being fixedly coupled to the backpack 12 and length adjustable by means of a buckle (not shown).

Each of a set of rings 38 that is hingedly coupled to the shell 22 is positioned proximate to a respective corner 40 of a back face 42 of the shell 22. The ring 38 is positioned to selectively couple to a respective hook 34 to removably couple the pair of shoulder straps 16 to the shell 22 so that the pair of shoulder straps 16 is configured to position over the shoulders of the user.

A set of panels 44 is coupled to the shell 22 so that the set of panels 44 defines a set of pockets 46. Each pocket 46 is configured to stow a respective item of the user. The set of panels 44 comprises a pair of side panels 48 that is coupled singly to the opposing sides 30 of the shell 22 and positioned externally to the shell 22 to define a pair of exterior side pockets 50. The side panels 48 are meshed and are resiliently stretchable. Each side panel 48 is configured to be stretched to insert a respective article, such as a water bottle, and to rebound to couple to the respective article.

Figure 6:
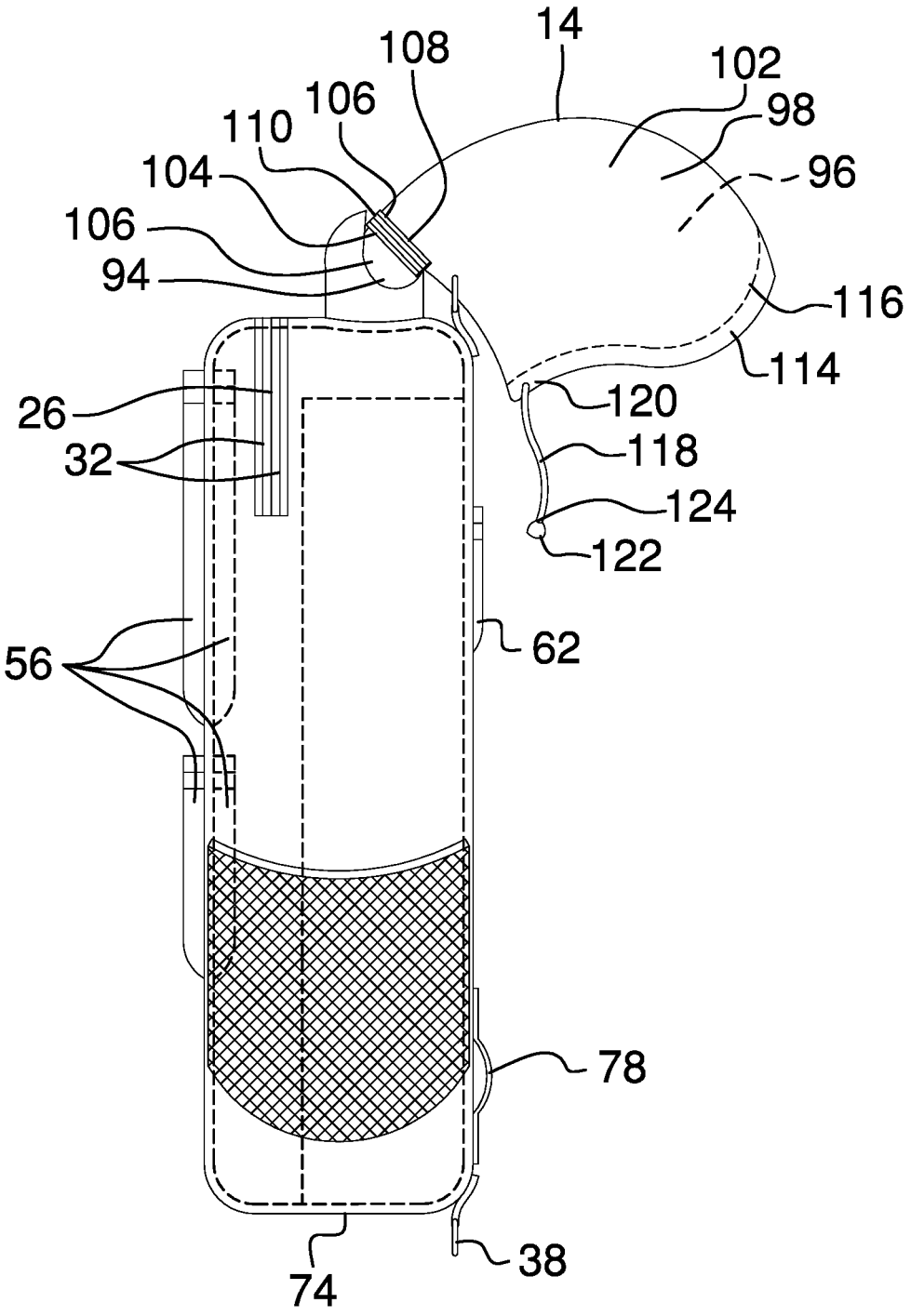
FIG. 6 is a side view of an embodiment of the disclosure.

The set of panels 44 also comprises a pair of front panels 52 that is coupled to a front face 54 of the shell 22 and positioned externally to the shell 22 to define a pair of exterior front pockets 56. One of the front panels 52 is circumferentially larger so that an associated exterior front pocket 56 is dimensionally larger, making the larger exterior front pocket 58 suitable for stowing a laptop computer. The exterior front pockets 56 are zippered and may extend into the interior space 24, as shown in FIG. 6.

The set of panels 44 also comprises a rear panel 60 that is coupled to the back face 42 and positioned externally to the shell 22 to define a rear pocket 62. The rear pocket 62 is zippered. As will be explained further below, the rear pocket 62 is designed to stow a bag 64 into which the backpack 12 can be inserted.

The set of panels 44 also comprises a pair of upper inside panels 66 and a pair of lower inside panels 142. The upper inside panels 66 are coupled singly to the opposing sides 30 proximate to the upper face 28 of the shell 22 and positioned in the interior space 24 to define a pair of upper interior pockets 144. The lower inside panels 142 are coupled singly to the front face 54 of the shell 22 and positioned in the interior space 24 to define a pair of lower interior pockets 68 that are designed to stow a cellular phone and a glasses case.

A set of dividers 70 is coupled to the shell 22 and positioned in the interior space 24 to define a set of compartments 72. Each divider 70 is coupled to and extends from a lower face 74 and the back face 42 of the shell 22 to proximate to the upper face 28 and the front face 54 of the shell 22, respectively. The set of dividers 70 may comprise one divider 70 that defines two compartments 72. The compartments 72 allow the user to segregate contents of the backpack 12.

A set of cylinder sleeves 76 is coupled to the front face 54 and positioned in the interior space 24 proximate to the lower face 74. The cylinder sleeves 76 are resiliently stretchable. Each cylinder sleeve 76 is configured to be stretched to insert a substantially cylindrically shaped article, such as a pen and a pencil, and to rebound to couple the substantially cylindrically shaped article to the shell 22. The set of cylinder sleeves 76 comprises from one to ten cylinder sleeves 76. The set of cylinder sleeves 76 may comprise seven cylinder sleeves 76, as shown in FIG. 1.

A pair of loops 78 is coupled to the back face 42 proximate to the lower face 74 of the shell 22. A waist strap 80 that is selectively positionable through the pair of loops 78 is configured to position around a waist of the user. A first fastener 82 and a second fastener 86 are coupled to a first end 84 and a second end 88 of the waist strap 80, respectively. The second fastener 86 is complementary to the first fastener 82 so that the second fastener 86 is positioned to removably couple to the first fastener 82 to secure the waist strap 80 around the waist of the user. The second fastener 86 and the first fastener 82 may comprise a side release buckle 90, or other fastening means, such as, but not limited to, hook and loop fasteners, belt buckles, and the like.

The hood 14 is coupled to and positioned in a pouch 92 that is coupled to the upper limit 18 proximate to the rear 20 of the backpack 12. The hood 14 is selectively extensible from the pouch 92 through a pouch opening 94 that is positioned in the pouch 92. The hood 14 is configured to cover a head of the user to protect the head of the user from windchill and moisture.

The hood 14 comprises an inner layer 96 and an outer layer 98. The inner layer 96 comprises synthetic fiber, such as, but not limited to, expanded polytetrafluoroethylene and the like. The inner layer 96 thus is configured to protect the head of the user from windchill. The outer layer 98 may comprise fabric that is laminated to at least one of rubber, polyvinyl chloride, polyurethane, and silicone elastomer. The outer layer 98 also may comprise fabric that is coated with at least one of fluoropolymer and wax. The outer layer 98 thus is configured to shield the head of the user from moisture.

The hood 14 comprises an extender section 100 and a hoodie section 102. The extender section 100 is coupled to the pouch 92. The hoodie section 102 is removably couplable to the extender section 100 distal from the pouch 92. A first connector 104 is coupled to the extender section 100. A second connector 106 is coupled to a rear edge 108 of the hoodie section 102. The second connector 106 is complementary to the first connector 104 so that the second connector 106 is positioned to selectively couple to the first connector 104 to removably couple the hoodie section 102 to the extender section 100. The second connector 106 and the first connector 104 may comprises a hoodie zipper 110, as shown in FIG. 6, or other connecting means, such as, but not limited to, hook and loop fasteners, buttons, snaps, and the like.

A pouch closure 112 is coupled to the pouch 92 proximate to the pouch opening 94 so that the pouch closure 112 is positioned to selectively close the pouch opening 94. The pouch closure 112 may be zipper type, or other closure type, such as, but not limited to, button type, snap type, hook and loop fastener type, and the like.

A hoodie sleeve 114 is coupled to a perimeter 116 of the hood 14. A cord 118 is positioned in the hoodie sleeve 114 and extends from opposing ends 120 of the hoodie sleeve 114. The cord 118 is configured to be drawn to tighten the hood 14 to the head of the user. Each of a pair of knobs 122 is coupled to a respective opposing terminus 124 of the cord 118. The knob 122 is positioned to prevent the respective opposing terminus 124 from being drawn into the hoodie sleeve 114.

Figure 7:
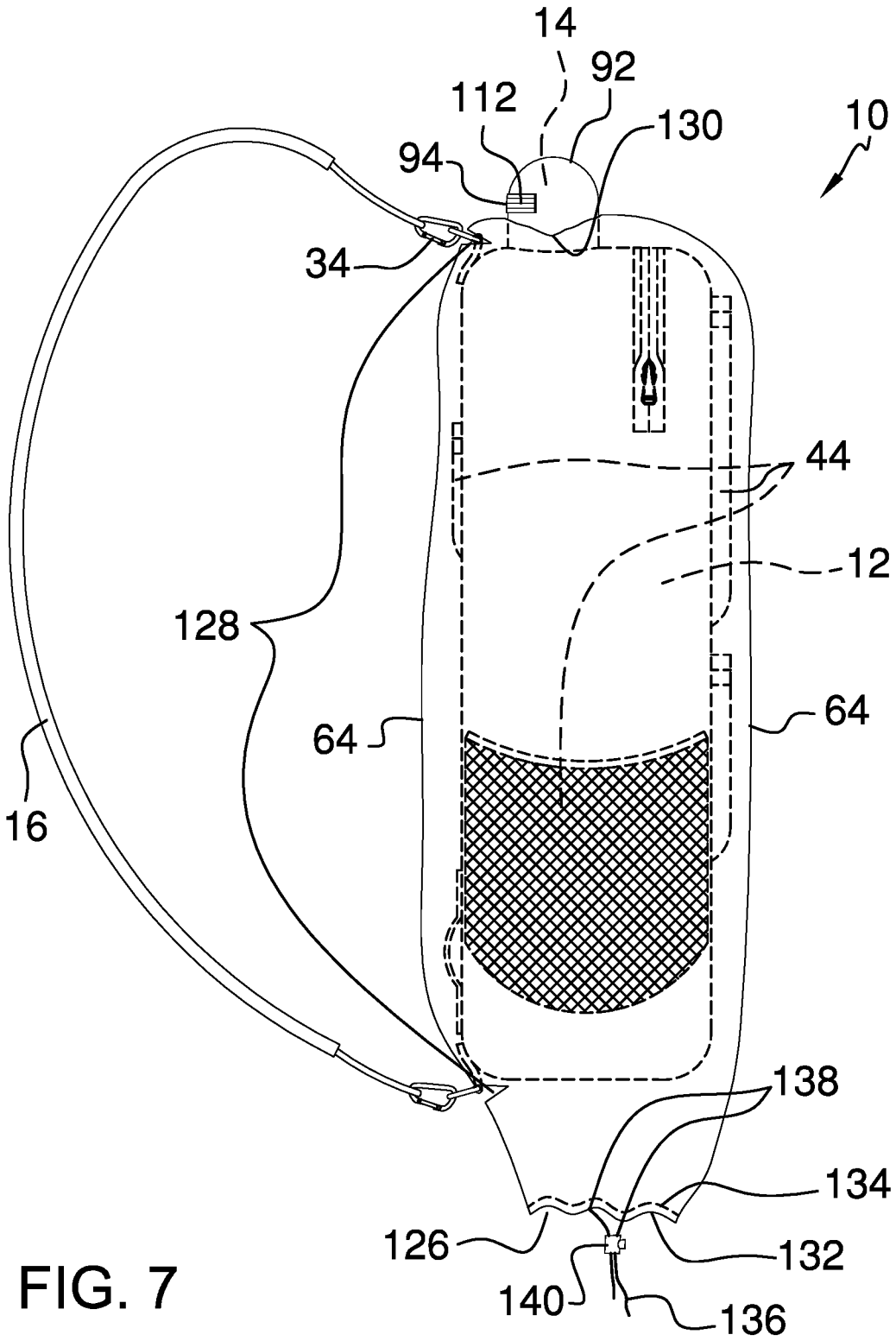
FIG. 7 is a detail view of an embodiment of the disclosure.

The device 10 also may comprise the bag 64, which is shaped complementary to the backpack 12. A bag opening 126 of the bag 64 is positioned to selectively insert the backpack 12 into the bag 64, as shown in FIG. 7. The bag 64 is configured to shield the backpack 12 and contents thereof from rain.

A set of apertures 128 is positioned in the bag 64 so that each aperture 128 is positioned to insert a respective ring 38 as the backpack 12 is inserted into the bag 64.

The set of apertures 128 allows the pair of shoulder straps 16 to be coupled to the backpack 12 after the backpack 12 has been positioned in the bag 64. A cutout 130 is positioned in the bag 64 so that the cutout 130 is positioned to insert the pouch 92 as the backpack 12 is inserted into the bag 64. The cutout 130 allows access to the pouch 92 so that the hood 14 can be deployed after the backpack 12 has been positioned in the bag 64.

A bag sleeve 132 is coupled to a circumference 134 of the bag opening 126. A drawstring 136 is positioned in the bag sleeve 132 and extends from opposing endpoints 138 of the bag sleeve 132. The drawstring 136 is configured to be drawn to close the bag opening 126. A coupler 140 is slidably coupled to the drawstring 136 so that the drawstring 136 is loopedly positioned in the bag sleeve 132. The coupler 140 is selectively couplable to the drawstring 136 so that the coupler 140 is positioned to couple to the drawstring 136 to selectively size the bag opening 126. The coupler 140 may be cord lock type, or other coupling type, such as, but not limited to, clip type, clamp type, and the like.

In use, the backpack 12 is utilized as per prior art backpacks to stow and transport articles. In the event the user encounters wind or rain, the hood 14 is selectively deployable from the pouch 92 to cover the user's head. The device 10 is anticipated to be particularly useful to students in travelling to and from a school campus and between buildings of the campus.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A backpack and hood combination device comprising:

a backpack comprising a pair of shoulder straps configured for positioning over shoulders of a user for coupling the backpack to the user such that an upper limit of the backpack is positioned proximate to a base of a neck of the user and such that a rear of the backpack substantially abuts a back of the user;

a pouch coupled to the upper limit proximate to the rear of the backpack;

a hood coupled to and positioned in the pouch, the hood being selectively extensible from the pouch through a pouch opening positioned in the pouch wherein the hood is configured for covering a head of the user for protecting the head of the user from windchill and moisture; and a bag shaped complementary to the backpack such that a bag opening of the bag is positioned for selectively inserting the backpack into the bag wherein the bag is configured for shielding the backpack and contents thereof from rain; a set of apertures positioned in the bag such that each aperture is positioned for inserting a respective ring as the backpack is inserted into the bag; a cutout positioned in the bag such that the cutout is positioned for inserting the pouch as the backpack is inserted into the bag; a bag sleeve coupled to a circumference of the bag opening; a drawstring positioned in the bag sleeve and extending from opposing endpoints of the bag sleeve wherein the drawstring is configured for drawing for closing the bag opening; and a coupler slidably coupled to the drawstring such that the drawstring is loopedly positioned in the bag sleeve, the coupler being selectively couplable to the drawstring such that the coupler is positioned for coupling to the drawstring for selectively sizing the bag opening.

2. The device of claim 1, further including the shoulder straps being padded.

3. The device of claim 1, further including the backpack comprising:

a set of hooks, the hooks being coupled singly to opposing limits of the shoulder straps;

a shell defining an interior space, the shell comprising synthetic fiber such that the shell is resiliently flexible and substantially water resistant;

a slit positioned in an upper face of the shell and extending into opposing sides of the shell wherein the slit is configured for accessing the interior space;

a slit closure coupled to the shell proximate to the slit such that the slit closure is positioned for selectively closing the slit;

a set of rings hingedly coupled to the shell, each ring being positioned proximate to a respective corner of a back face of the shell such that the ring is positioned for selectively coupling to a respective hook for removably coupling the pair of shoulder straps to the shell such that the pair of shoulder straps is configured for positioning over the shoulders of the user;

a set of panels coupled to the shell such that the set of panels defines a set of pockets wherein each pocket is configured for stowing a respective item of the user;

a set of dividers coupled to the shell and positioned in the interior space defining a set of compartments, each divider being coupled to and extending from a lower face and the back face of the shell to proximate to the upper face and a front face of the shell, respectively; and a set of cylinder sleeves coupled to the front face and positioned in the interior space proximate to the lower face, the cylinder sleeves being resiliently stretchable wherein each cylinder sleeve is configured for stretching for inserting a substantially cylindrically shaped article and for rebounding for coupling the substantially cylindrically shaped article to the shell.

4. The device of claim 3, further comprising:

the hooks being carabiner type; and the slit closure being waterproof zipper type.

5. The device of claim 3, further including the shell being substantially rectangularly box shaped.

6. The device of claim 3, further comprising:

the set of dividers comprising one divider; and the set of cylinder sleeves comprising from one to ten cylinder sleeves.

7. The device of claim 6, further including the set of cylinder sleeves comprising seven cylinder sleeves.

8. The device of claim 3, further including the set of panels comprising:

a pair of side panels coupled singly to the opposing sides of the shell and positioned externally to the shell defining a pair of exterior side pockets, the side panels being meshed, the side panels being resiliently stretchable wherein each side panel is configured for stretching for inserting a respective article and for rebounding for coupling to the respective article;

a pair of front panels coupled to the front face of the shell and positioned externally to the shell defining a pair of exterior front pockets, one of the front panels being circumferentially larger such that an associated exterior front pocket is dimensionally larger, the exterior front pockets being zippered;

a rear panel coupled to the back face and positioned externally to the shell defining a rear pocket, the rear pocket being zippered;

a pair of upper inside panels coupled singly to the opposing sides proximate to the upper face of the shell and positioned in the interior space defining a pair of upper interior pockets; and a pair of lower inside panels coupled singly to the front face of the shell and positioned in the interior space defining a pair of lower interior pockets.

9. The device of claim 8, further including the exterior front pockets extending into the interior space.

10. The device of claim 3, further comprising:

a pair of loops coupled to the back face proximate to the lower face of the shell;

a waist strap selectively positionable through the pair of loops wherein the waist strap is configured for positioning around a waist of the user;

a first fastener coupled to a first end of the waist strap; and a second fastener coupled to a second end of the waist strap, the second fastener being complementary to the first fastener such that the second fastener is positioned for removably coupling to the first fastener for securing the waist strap around the waist of the user.

11. The device of claim 10, further including the second fastener and the first fastener comprising a side release buckle.

12. The device of claim 1, further including the hood comprising an inner layer and an outer layer, the inner layer comprising synthetic fiber wherein the inner layer is configured for protecting the head of the user from windchill, the outer layer comprising at least one of fabric laminated to at least one of rubber, polyvinyl chloride, polyurethane, and silicone elastomer and fabric coated with at least one of fluoropolymer and wax wherein the outer layer is configured for shielding the head of the user from moisture.

13. The device of claim 1, further comprising:

the hood comprising an extender section and a hoodie section, the extender section being coupled to the pouch, the hoodie section being removably couplable to the extender section distal from the pouch;

a first connector coupled to the extender section; and a second connector coupled to a rear edge of the hoodie section, the second connector being complementary to the first connector such that the second connector is positioned for selectively coupling to the first connector for removably coupling the hoodie section to the extender section.

14. The device of claim 13, further including the second connector and the first connector comprising a hoodie zipper.

15. The device of claim 1, further including a pouch closure coupled to the pouch proximate to the pouch opening such that the pouch closure is positioned for selectively closing the pouch opening.

16. The device of claim 15, further including the pouch closure being zipper type.

17. The device of claim 1, further comprising:

a hoodie sleeve coupled to a perimeter of the hood;

a cord positioned in the hoodie sleeve and extending from opposing ends of the hoodie sleeve wherein the cord is configured for drawing for tightening the hood to the head of the user; and a pair of knobs, each knob being coupled to a respective opposing terminus of the cord such that the knob is positioned for preventing the respective opposing terminus from being drawn into the hoodie sleeve.

18. The device of claim 1, further including the coupler being cord lock type.

19. A backpack and hood combination device comprising:

a backpack comprising a pair of shoulder straps configured for positioning over shoulders of a user for coupling the backpack to the user such that an upper limit of the backpack is positioned proximate to a base of a neck of the user and such that a rear of the backpack substantially abuts a back of the user, the shoulder straps being padded, the backpack comprising:

a set of hooks, the hooks being coupled singly to opposing limits of the shoulder straps, the hooks being carabiner type, a shell defining an interior space, the shell comprising synthetic fiber such that the shell is resiliently flexible and substantially water resistant, the shell being substantially rectangularly box shaped, a slit positioned in an upper face of the shell and extending into opposing sides of the shell wherein the slit is configured for accessing the interior space, a slit closure coupled to the shell proximate to the slit such that the slit closure is positioned for selectively closing the slit, the slit closure being waterproof zipper type, a set of rings hingedly coupled to the shell, each ring being positioned proximate to a respective corner of a back face of the shell such that the ring is positioned for selectively coupling to a respective hook for removably coupling the pair of shoulder straps to the shell such that the pair of shoulder straps is configured for positioning over the shoulders of the user, a set of panels coupled to the shell such that the set of panels defines a set of pockets wherein each pocket is configured for stowing a respective item of the user, the set of panels comprising:

a pair of side panels coupled singly to the opposing sides of the shell and positioned externally to the shell defining a pair of exterior side pockets, the side panels being meshed, the side panels being resiliently stretchable wherein each side panel is configured for stretching for inserting a respective article and for rebounding for coupling to the respective article, a pair of front panels coupled to a front face of the shell and positioned externally to the shell defining a pair of exterior front pockets, one of the front panels being circumferentially larger such that an associated exterior front pocket is dimensionally larger, the exterior front pockets being zippered, the exterior front pockets extending into the interior space, a rear panel coupled to the back face and positioned externally to the shell defining a rear pocket, the rear pocket being zippered, a pair of upper inside panels coupled singly to the opposing sides proximate to the upper face of the shell and positioned in the interior space defining a pair of upper interior pockets, and a pair of lower inside panels coupled singly to the front face of the shell and positioned in the interior space defining a pair of lower interior pockets, a set of dividers coupled to the shell and positioned in the interior space defining a set of compartments, each divider being coupled to and extending from a lower face and the back face of the shell to proximate to the upper face and the front face of the shell, respectively, the set of dividers comprising one divider, and a set of cylinder sleeves coupled to the front face and positioned in the interior space proximate to the lower face, the cylinder sleeves being resiliently stretchable wherein each cylinder sleeve is configured for stretching for inserting a substantially cylindrically shaped article and for rebounding for coupling the substantially cylindrically shaped article to the shell, the set of cylinder sleeves comprising from one to ten cylinder sleeves, the set of cylinder sleeves comprising seven cylinder sleeves;

a pair of loops coupled to the back face proximate to the lower face of the shell;

a waist strap selectively positionable through the pair of loops wherein the waist strap is configured for positioning around a waist of the user;

a first fastener coupled to a first end of the waist strap;

a second fastener coupled to a second end of the waist strap, the second fastener being complementary to the first fastener such that the second fastener is positioned for removably coupling to the first fastener for securing the waist strap around the waist of the user, the second fastener and the first fastener comprising a side release buckle;

a pouch coupled to the upper limit proximate to the rear of the backpack;

a hood coupled to and positioned in the pouch, the hood being selectively extensible from the pouch through a pouch opening positioned in the pouch wherein the hood is configured for covering a head of the user for protecting the head of the user from windchill and moisture, the hood comprising an inner layer and an outer layer, the inner layer comprising synthetic fiber wherein the inner layer is configured for protecting the head of the user from windchill, the outer layer comprising at least one of fabric laminated to at least one of rubber, polyvinyl chloride, polyurethane, and silicone elastomer and fabric coated with at least one of fluoropolymer and wax wherein the outer layer is configured for shielding the head of the user from moisture, the hood comprising an extender section and a hoodie section, the extender section being coupled to the pouch, the hoodie section being removably couplable to the extender section distal from the pouch;

a first connector coupled to the extender section;

a second connector coupled to a rear edge of the hoodie section, the second connector being complementary to the first connector such that the second connector is positioned for selectively coupling to the first connector for removably coupling the hoodie section to the extender section, the second connector and the first connector comprising a hoodie zipper;

a pouch closure coupled to the pouch proximate to the pouch opening such that the pouch closure is positioned for selectively closing the pouch opening, the pouch closure being zipper type;

a hoodie sleeve coupled to a perimeter of the hood;

a cord positioned in the hoodie sleeve and extending from opposing ends of the hoodie sleeve wherein the cord is configured for drawing for tightening the hood to the head of the user;

a pair of knobs, each knob being coupled to a respective opposing terminus of the cord such that the knob is positioned for preventing the respective opposing terminus from being drawn into the hoodie sleeve;

a bag shaped complementary to the backpack such that a bag opening of the bag is positioned for selectively inserting the backpack into the bag wherein the bag is configured for shielding the backpack and contents thereof from rain;

a bag sleeve coupled to a circumference of the bag opening;

a set of apertures positioned in the bag such that each aperture is positioned for inserting a respective ring as the backpack is inserted into the bag;

a cutout positioned in the bag such that the cutout is positioned for inserting the pouch as the backpack is inserted into the bag;

a drawstring positioned in the bag sleeve and extending from opposing endpoints of the bag sleeve wherein the drawstring is configured for drawing for closing the bag opening; and a coupler slidably coupled to the drawstring such that the drawstring is loopedly positioned in the bag sleeve, the coupler being selectively couplable to the drawstring such that the coupler is positioned for coupling to the drawstring for selectively sizing the bag opening, the coupler being cord lock type.

* * * * *